US006647650B1

(12) United States Patent
Jones et al.

(10) Patent No.: US 6,647,650 B1
(45) Date of Patent: Nov. 18, 2003

(54) PROMOTIONAL DISPLAY APPARATUS WITH ROTATING PANEL

(75) Inventors: Brenda S. Jones, Raleigh, NC (US); Jason S. Holland, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 10/173,989

(22) Filed: Jun. 18, 2002

(51) Int. Cl.[7] ..... G09F 19/00
(52) U.S. Cl. ..... 40/409; 40/406
(58) Field of Search ..... 40/409, 406, 407, 40/410, 482, 152, 455, 470, 473, 484

(56) References Cited

U.S. PATENT DOCUMENTS

| | | | | | |
|---|---|---|---|---|---|
| 1,627,270 | A | * | 5/1927 | Burnham | 40/409 |
| 4,490,932 | A | * | 1/1985 | McIntire | 40/473 |
| 4,521,982 | A | | 6/1985 | Altuchow | 40/407 |
| 4,686,784 | A | | 8/1987 | Smithies | 40/406 |
| 4,934,079 | A | * | 6/1990 | Hoshi | 40/427 |
| 5,187,889 | A | | 2/1993 | Kraselsky et al. | 40/407 |
| 5,359,374 | A | * | 10/1994 | Schwartz | 40/455 |
| 5,365,686 | A | * | 11/1994 | Scott | 40/455 |
| 5,406,728 | A | | 4/1995 | Willitts, Jr. | 40/409 |
| 5,769,680 | A | | 6/1998 | Hoffman | 446/75 |
| 5,888,117 | A | | 3/1999 | Sutton | 446/267 |
| 5,985,379 | A | | 11/1999 | Longsdorf et al. | 428/13 |
| 6,050,414 | A | | 4/2000 | Saffron et al. | 206/457 |
| 6,165,041 | A | | 12/2000 | Lin | 446/267 |
| 6,171,560 | B1 | | 1/2001 | Pesu et al. | 422/305 |
| 6,179,153 | B1 | | 1/2001 | Huang | 220/553 |
| 6,263,600 | B1 | * | 7/2001 | Brink | 40/410 |
| 6,393,744 | B1 | * | 5/2002 | Snyder | 40/406 |
| 2002/0005002 | A1 | * | 1/2002 | Huang | 40/406 |
| 2002/0073585 | A1 | * | 6/2002 | Burnett | 40/406 |

* cited by examiner

*Primary Examiner*—Gary Hoge
(74) *Attorney, Agent, or Firm*—Myers Bigel Sibley & Sajovec

(57) ABSTRACT

Promotional apparatus are provided that are configured to demonstrate to patients and others how one or more pharmaceutical products work within the human body (or within other living beings). The promotional apparatus includes a base and a display panel that is movably secured to the base for rotational movement about an axis between a substantially vertical display position and a substantially vertical non-display position. The display panel includes first and second sealed chambers in adjacent relationship. Each chamber includes a respective transparent front wall and a rear wall spaced apart from the front wall. The first sealed chamber is substantially filled with a first translucent fluid and the second sealed chamber is substantially filled with a second translucent fluid. A first set of objects is disposed within the first sealed chamber and are configured to ascend through the translucent fluid (i.e., each object is buoyant) when the display panel is rotated to a display position. A second set of objects is disposed within the second sealed chamber and are configured to descend through the translucent fluid within the second sealed chamber (i.e., each object is not buoyant) when the display panel is rotated to a display position.

40 Claims, 10 Drawing Sheets

PROMOTIONAL DISPLAY APPARATUS WITH ROTATING PANEL

FIELD OF THE INVENTION

The present invention relates generally to product promotion and, more particularly, to the promotion of healthcare-related products.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens, when used by the physicians, will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to physicians and other healthcare providers.

SUMMARY OF THE INVENTION

In view of the above discussion, promotional apparatus are provided that are configured to demonstrate to patients and others how a particular pharmaceutical product works within the human body (or within other living beings). The promotional apparatus includes a base and a display panel that is movably secured to the base for rotational movement about an axis between a substantially vertical display position and a substantially vertical non-display position. The display panel includes first and second sealed chambers in adjacent relationship. Each chamber includes a respective transparent front wall and a rear wall spaced apart from the front wall. The first sealed chamber is substantially filled with a first translucent fluid and the second sealed chamber is substantially filled with a second translucent fluid.

According to embodiments of the present invention, a first set of objects is disposed within the first sealed chamber and each object is configured to ascend through the translucent fluid (i.e., each object is buoyant). A second set of objects is disposed within the second sealed chamber and each object is configured to descend through the translucent fluid within the second sealed chamber (i.e., each object is not buoyant).

According to embodiments of the present invention, the front wall of each sealed chamber includes respective opaque images. Each respective image includes one or more transparent portions through which movement of the objects within the respective first and second chambers can be viewed when the display panel is moved to the display position. According to embodiments of the present invention, an image is affixed to the rear wall of each of the first and second sealed chambers so as to be visible through the transparent portions of the respective images and so as to facilitate the portrayal of passageways within a human body.

Initially, the display panel is in a substantially vertical non-display position. To begin a demonstration, a user rotates the display panel substantially 180° from the initial position to the operative position such that the objects within the first sealed chamber are buoyant and move upwardly within the fluid in the first sealed chamber. The configuration of the images on the front and rear walls and the transparent portions help demonstrate the movement of objects to a specific location in a human body. The objects within the-second sealed chamber are not buoyant and move downwardly through the fluid in the second sealed chamber. The configuration of the images on the front and rear walls of the second sealed chamber and the transparent portions help demonstrate a drug reacting with cells in a specific location of a human body.

According to embodiments of the present invention, promotional apparatus are provided that include panels configured to rotate in multiple directions. In addition, promotional apparatus are provided that include multiple rotatable panels.

BRIEF DESCRIPTION OF THE DRAWINGS

The accompanying drawings, which form a part of the specification, illustrate key embodiments of the present invention. The drawings and description together serve to fully explain the invention.

DETAILED DESCRIPTION OF THE INVENTION

Figure 1:
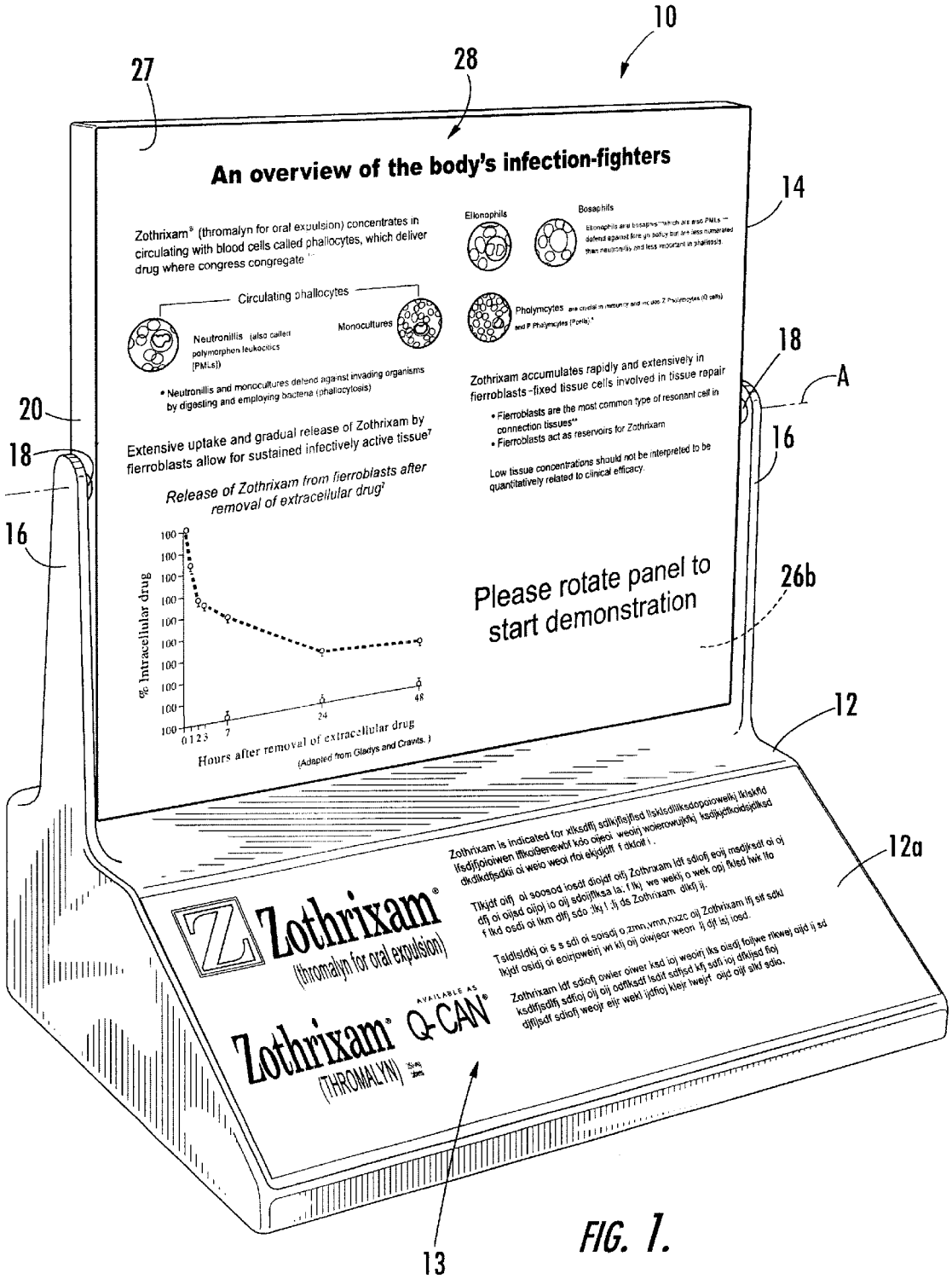
FIG. 1 is a perspective view of a promotional display apparatus according to embodiments of the present invention, wherein a rotatable panel is in a substantially vertical non-display position.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element such as a layer, region, substrate, label, image, or panel is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present.

Referring now to FIG. 1, a promotional apparatus 10 according to embodiments of the present invention is illustrated. The illustrated promotional apparatus 10 is intended to be used by healthcare providers to educate patients and others on one or more particular pharmaceutical products. The illustrated promotional apparatus 10 includes a base 12 and a display panel 14 that is movably secured to the base for rotational movement about an axis A. As will be described in detail below, the display panel 14 is rotatable about axis A between a substantially vertical display position (FIG. 2) and a substantially vertical non-display position (FIG. 1). In the illustrated embodiment, the display panel 14 is supported by two spaced-apart arms 16 that extend upwardly from the base 12. Rotational movement of the display panel 14 is facilitated by a pair of pins 18 which extend outwardly from respective opposite edge portions 20 of the panel 14 and matingly engage respective sockets (not shown) in the arms 16 for rotational movement. However, various ways of supporting the display panel 14 for rotational movement (and known to those skilled in the art) may be utilized. Embodiments of the present invention are not limited to a particular way of securing the display panel 14 to the base 12 for rotational movement.

The illustrated display panel 14 is rectangular in shape; however, embodiments of the present invention are not limited to rectangular-shaped display panels. The display panel 14 may have various shapes and sizes without limitation. The display panel 14 may be formed from various materials including, but not limited to, thermosetting polymers, thermoplastic polymers, glass, etc.

The illustrated base 12 includes a front surface 12*a* that includes indicia 13 thereon. The illustrated indicia 13 describes a particular pharmaceutical product that is the subject of the demonstration that occurs when the display panel 14 is moved to the substantially vertical display position. Although not illustrated, the base 12 may include drawers and/or pull-out cards that may contain additional information for a user. Embodiments of the present invention are not limited to the illustrated base 12. A display apparatus according to embodiments of the present invention can have various shapes and sizes.

Figure 4:
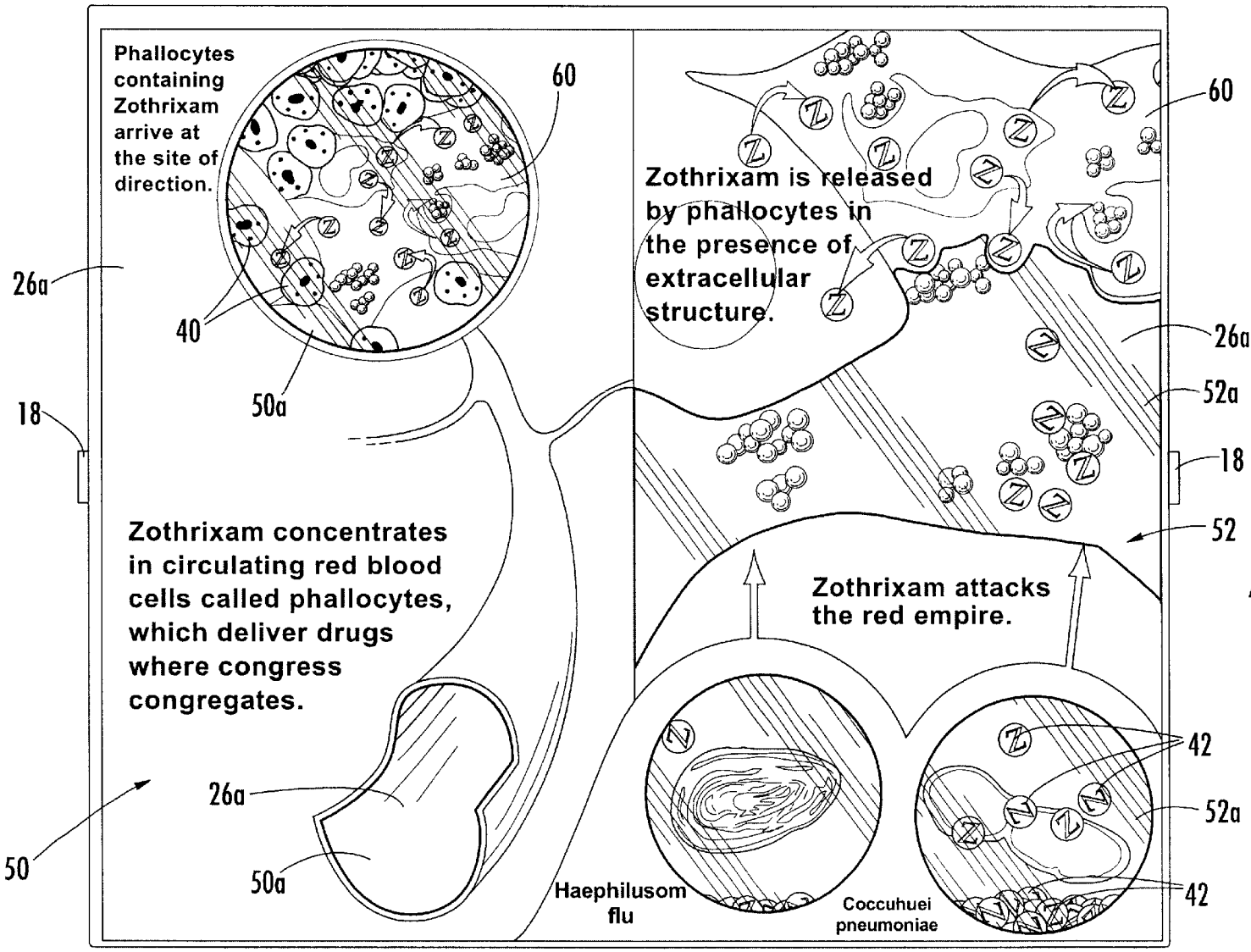
FIG. 4 is a front plan view of the display panel of the display apparatus of FIG. 1.
Figure 5:
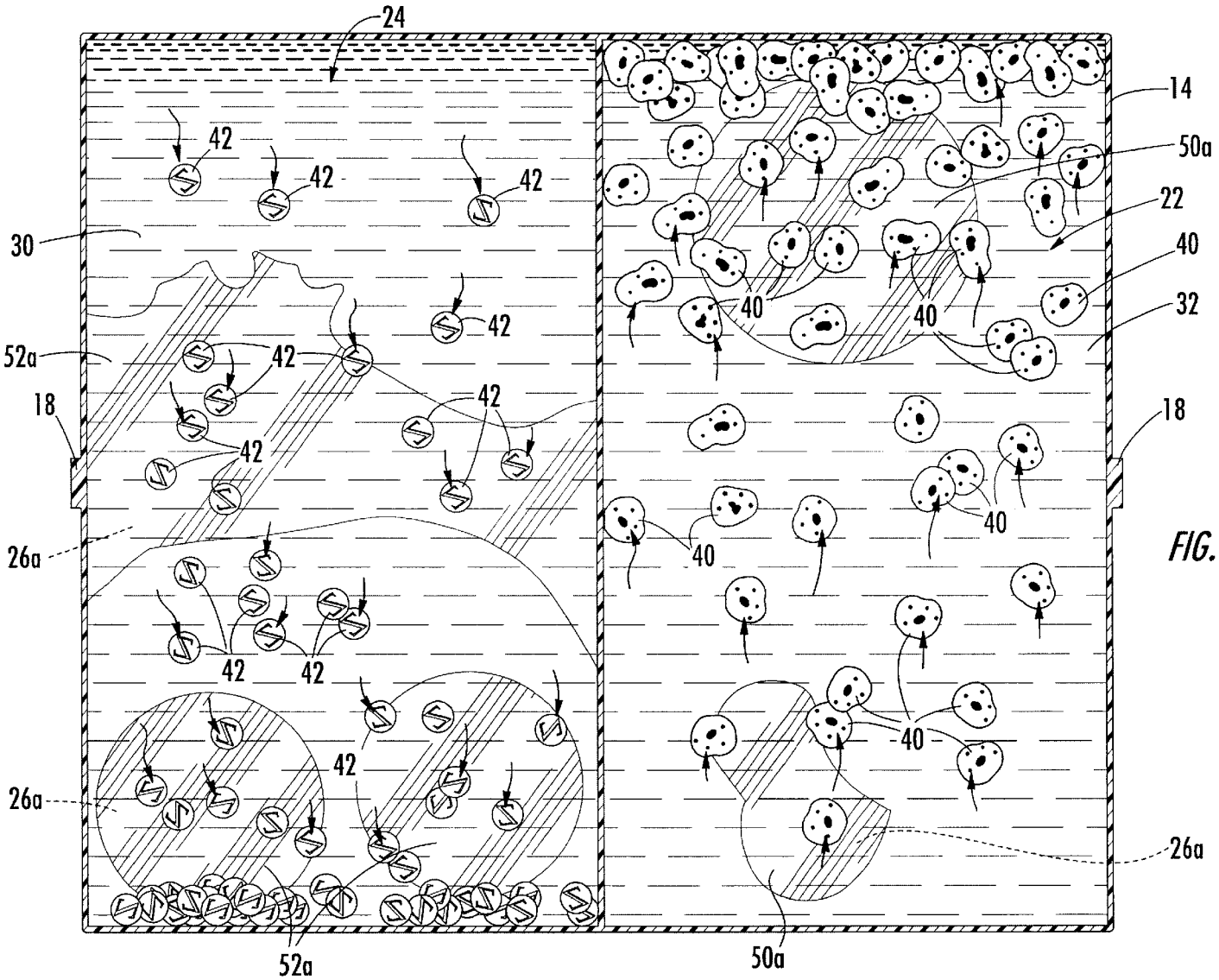
FIG. 5 is a cross-sectional view of the display panel of the display apparatus of FIG. 2 taken along line 5—5.

Referring to FIGS. 2–5, the illustrated display panel 14 includes first and second sealed chambers 22,24 in adjacent relationship. Each chamber 22,24 includes a respective transparent front wall 26*a* and a rear wall 26*b* spaced apart from the front wall 26*a*. As best seen in FIG. 5, the first sealed chamber 22 is substantially filled with a first translucent fluid 30. The second sealed chamber 24 is substantially filled with a second translucent fluid 32. The first and second translucent fluids 30,32 may be the same or different fluids. The first and second translucent fluids 30,32 may have respective viscosities that are substantially the same or substantially different. Moreover, the first and second translucent fluids 30,32 may be clear or may have various colors. Exemplary translucent fluids which may be utilized as the first and second fluids 30,32 include, but are not limited to, water, glycerin, and mineral oil. Preferably, a non-toxic, environmentally-neutral fluid is utilized for the first and second fluids 30,32.

Still referring to FIG. 5, a first set of objects 40 is disposed within the first sealed chamber 22. In the illustrated embodiment, each object 40 is configured to ascend through the translucent fluid 30 (i.e., each object 40 is buoyant). A second set of objects 42 is disposed within the second sealed chamber 24. In the illustrated embodiment, each object 42 is configured to descend through the translucent fluid 32 within the second sealed chamber 24 (i.e., each object 42 is not buoyant). As will be explained below, movement of the first and second sets of objects 40,42 within the first and second sealed chambers 22,24 is viewable via the transparent front wall 26*a* of the first and second chambers 22,24.

Figure 2:
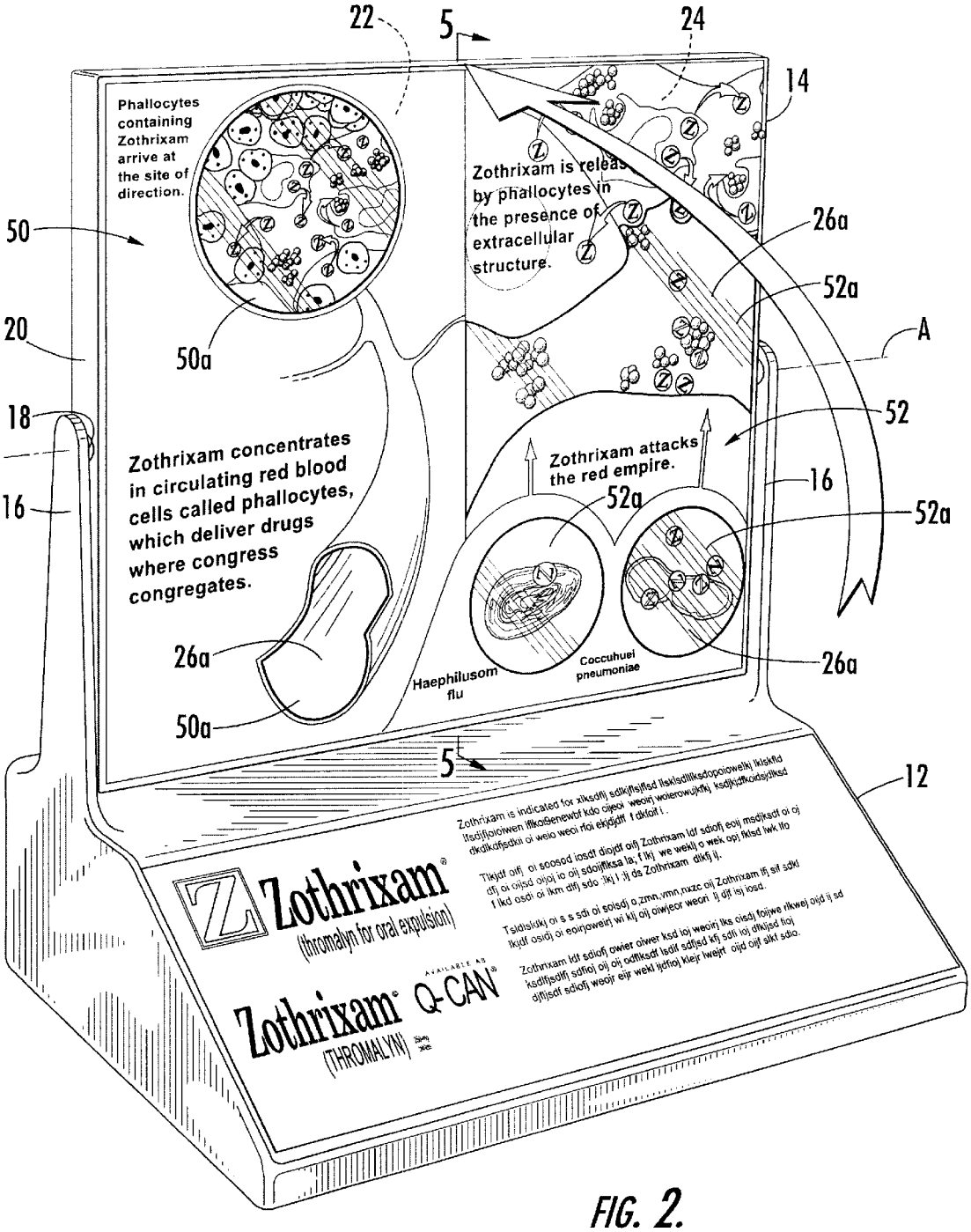
FIG. 2 is a perspective view of the promotional display apparatus of FIG. 1, wherein the rotatable panel has been rotated to a substantially vertical display position.
Figure 3:
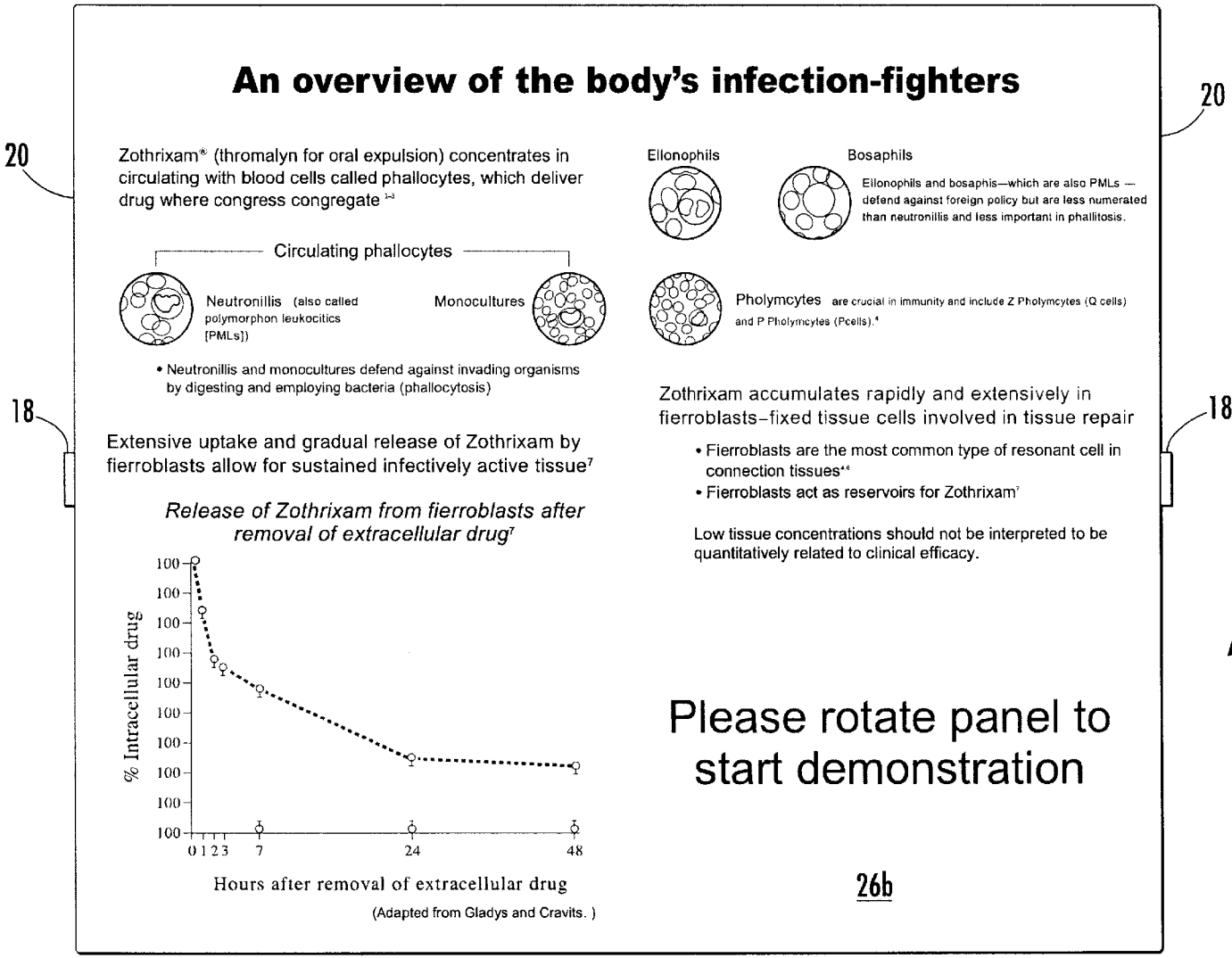
FIG. 3 is a rear plan view of the display panel of the display apparatus of FIG. 1.

In the illustrated embodiment, the first set of objects 40 are configured to be buoyant within the first fluid 30 such that each object 40 in the first set ascends through the first fluid 30 within the first sealed chamber 22 when the display panel 14 is moved to the substantially vertical display position (FIG. 2). The second set of objects 42 are configured to be less buoyant within the second fluid 32 such that each object 42 in the second set descends through the second fluid 32 within the second sealed chamber 24 when the display panel 14 is moved to the substantially vertical display position (FIG. 2).

Referring back to FIG. 1, the display panel 14 is in a substantially vertical non-display position. The sealed chambers 22,24 are not visible through the rear wall 26*b* because a non-transparent label 27 containing indicia 28 thereon is adhered to the rear walls 26*b* of both the first and second sealed chambers 22,24. As would be understood by those skilled in the art, the label 27 may be adhered to either an outer or inner surface of the rear wall 26*b*. The purpose of the non-transparent label 27 is to prevent users from viewing the sealed chambers 22,24 and the respective objects 40,42 therein when the display panel 14 is in the non-display position. As such, embodiments of the present invention are not limited to a label applied to the rear walls 26*b* of the first and second sealed chambers 22,24. The rear walls 26*b* could be formed of a non-transparent material or could be covered with any type of non-transparent material. The indicia 28 on the illustrated label 27 is provided to explain the demonstration that occurs when the display panel 14 is moved to the substantially vertical display position and/or to provide information about the pharmaceutical product that is the subject of the demonstration.

Referring to FIG. 2, the front wall 26*a* of each sealed chamber 22,24 of the illustrated embodiment includes respective opaque images 50,52. Each respective image 50,52 includes one or more transparent portions 50*a*,52*a* through which movement of the objects 40,42 within the respective first and second chambers 22,24 can be viewed when the display panel 14 is moved to the display position. In the illustrated embodiment, each respective image 50,52 portrays a respective passageway in a human body and, as will be described below, movement of the display panel 14 causes movement of the objects 40,42 within the respective portrayed passageways. In the illustrated embodiment, the portrayed passageway is an artery within a human body.

Referring to FIG. 4, an image 60 is affixed to the rear wall 26*b* of each of the first and second sealed chambers 22,24 so as to be visible through the transparent portions 50*a*,52*a* of the respective images 50,52. As would be understood by those skilled in the art, an image 60 may be affixed to the inner surfaces or outer surfaces of the rear wall 26*b* of the first and second sealed chambers 22,24. The illustrated image 60 visible through the illustrated transparent portions 50*a*,52*a* facilitates the portrayal of passageways within a human body.

Referring back to FIGS. 1 and 2, operation of the display apparatus 10 will be described. Initially, the display panel 14 is in the substantially vertical non-display position of FIG. 1. To begin the demonstration, a user rotates the display panel 14 from the illustrated position of FIG. 1 to the illustrated position of FIG. 2. In the illustrated embodiment, the objects 40 within the first sealed chamber 22 are buoyant and move upwardly within the fluid in the first sealed chamber 22. The configuration of the images on the front and rear walls 26*a*,26*b* and the transparent portions 50*a* give the illusion of a pharmaceutical product (represented by the objects 40) moving through an artery to a specific location in the human body. The objects 42 within the second sealed chamber 24 are not buoyant and move downwardly through the fluid in the second sealed chamber 24. The configuration of the images on the front and rear walls 26*a*,26*b* of the second sealed chamber 24 and the transparent portions 52*a* give the illusion of a drug reacting with cells in a specific location of a human body.

In the illustrated embodiment, the objects 40 represent a pharmaceutical product that flow within an artery or other blood-carrying passageway of the human body to a specific site within the human body (first sealed chamber 22). The pharmaceutical product attacks a specific pathogen at the specific site within the human body (second sealed chamber 24). Indicia displayed on both the front and rear walls 26*a*,26*b* of the first and second sealed chambers 22,24 of the display panel 14 is provided to inform users about the pharmaceutical product which is the subject of the demonstration. Various promotional indicia may be provided as well. In addition, the objects 40,42 disposed within the first and second sealed chambers 22,24 may include promotional indicia thereon to facilitate the demonstration. For example, in the illustrated embodiment, the objects 40,42 include a tablet or pill with a "Z" thereon that would be approximately the same indicia as on a real tablet or pill.

Objects 40,42 may have any size, color, shape and the like depending on the overall appearance desired. According to embodiments of the present invention, certain ones of the objects 40,42 and the viscosity of the first and second fluids 30,32 may be arranged so that when the display panel 14 is rotated to its display position, various ones of the objects 40,42 ascend and/or descend at varying rates of speed relative to other objects.

Figure 8:
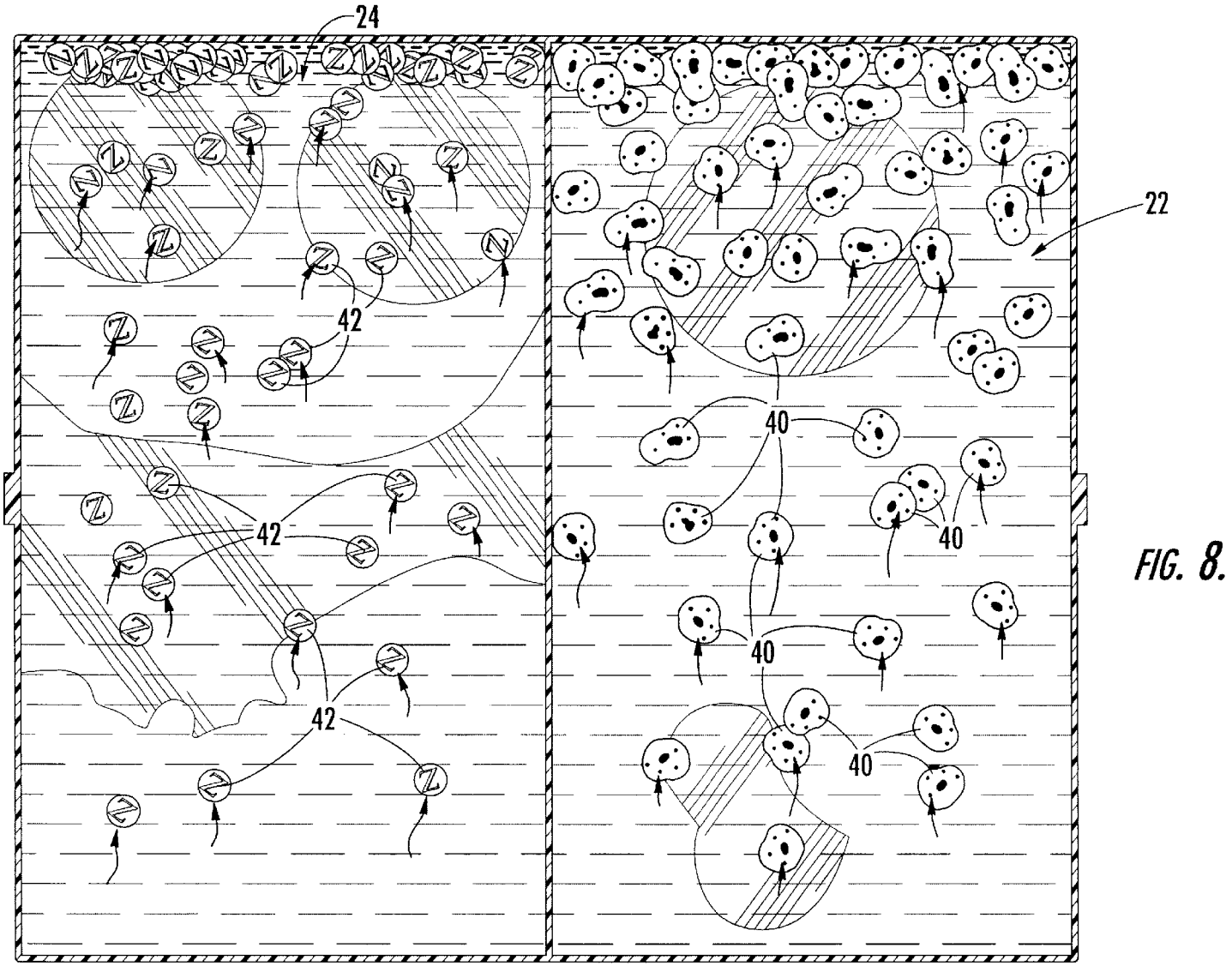
FIG. 8 is a cross-sectional view of the display panel of the display apparatus of FIG. 1 taken along line 5—5 and illustrating movement of the objects within the first and second sealed chambers in the same direction.

According to other embodiments of the present invention, objects 40 within the first sealed chamber 22 may be configured to descend within the fluid when the display panel 14 is rotated to the display position. Moreover, some of the objects 40 within the first sealed chamber 22 may be configured descend while other objects 40 are configured to ascend. In addition, embodiments of the present invention may allow for at least some of the objects 40,42 within the first and second sealed chambers 22,24 to move in the same direction (i.e., either ascend or descend). For example, FIG. 8 illustrates objects 40,42 moving in the same direction within the respective first and second fluids 30,32.

Figure 6:
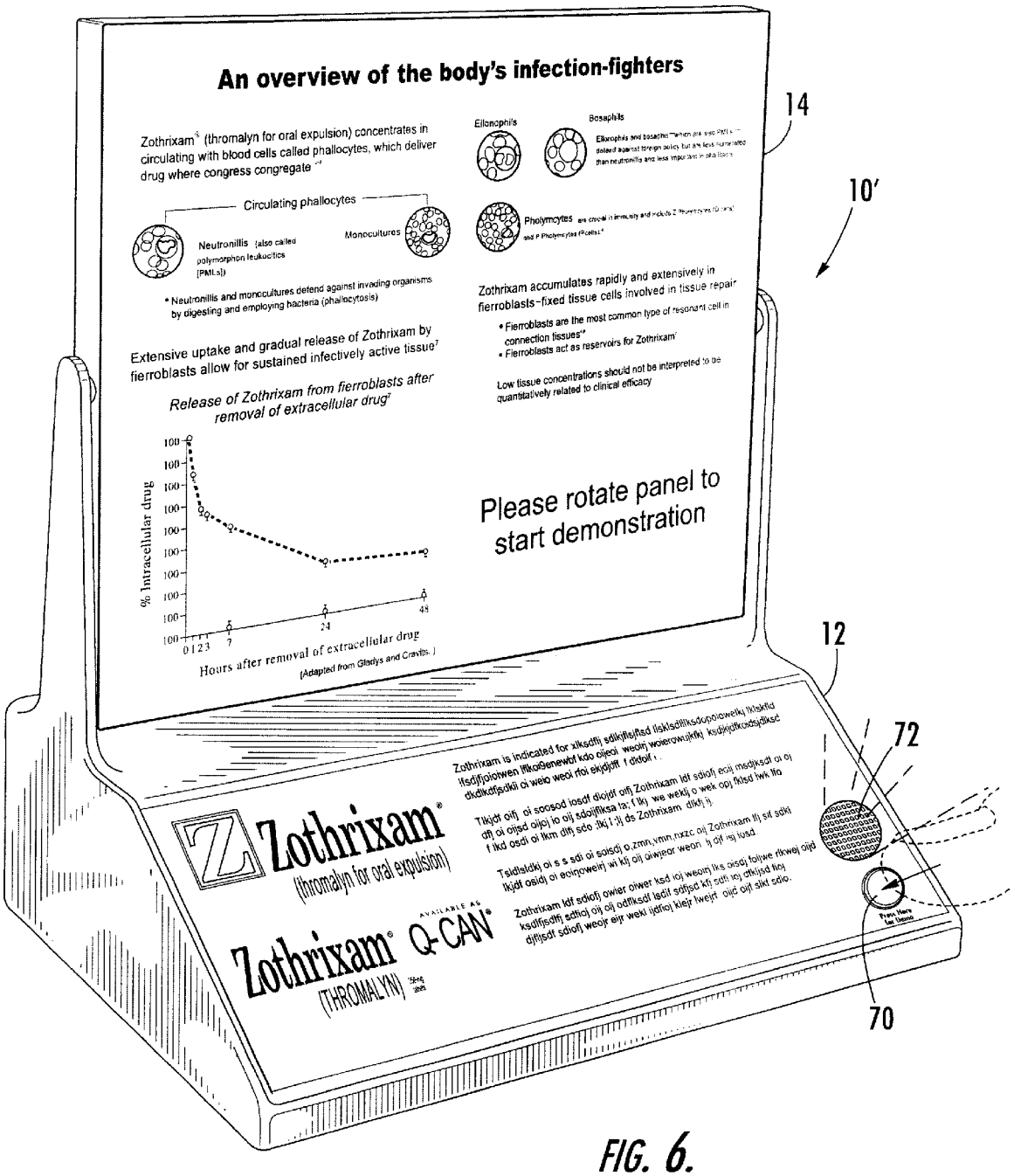
FIG. 6 is a perspective view of a promotional display apparatus according to alternative embodiments of the present invention.

According to another embodiment of the present invention illustrated in FIG. 6, a promotional display apparatus 10' may provide audio accompaniment to the demonstration. In the illustrated embodiment, a user presses a button 70 on the base 12 to begin the audio performance via speaker 72. Various audio performance devices may be utilized including, but not limited to, tape, memory devices, and the like, all of which are well known to those skilled in the art.

Figure 7:
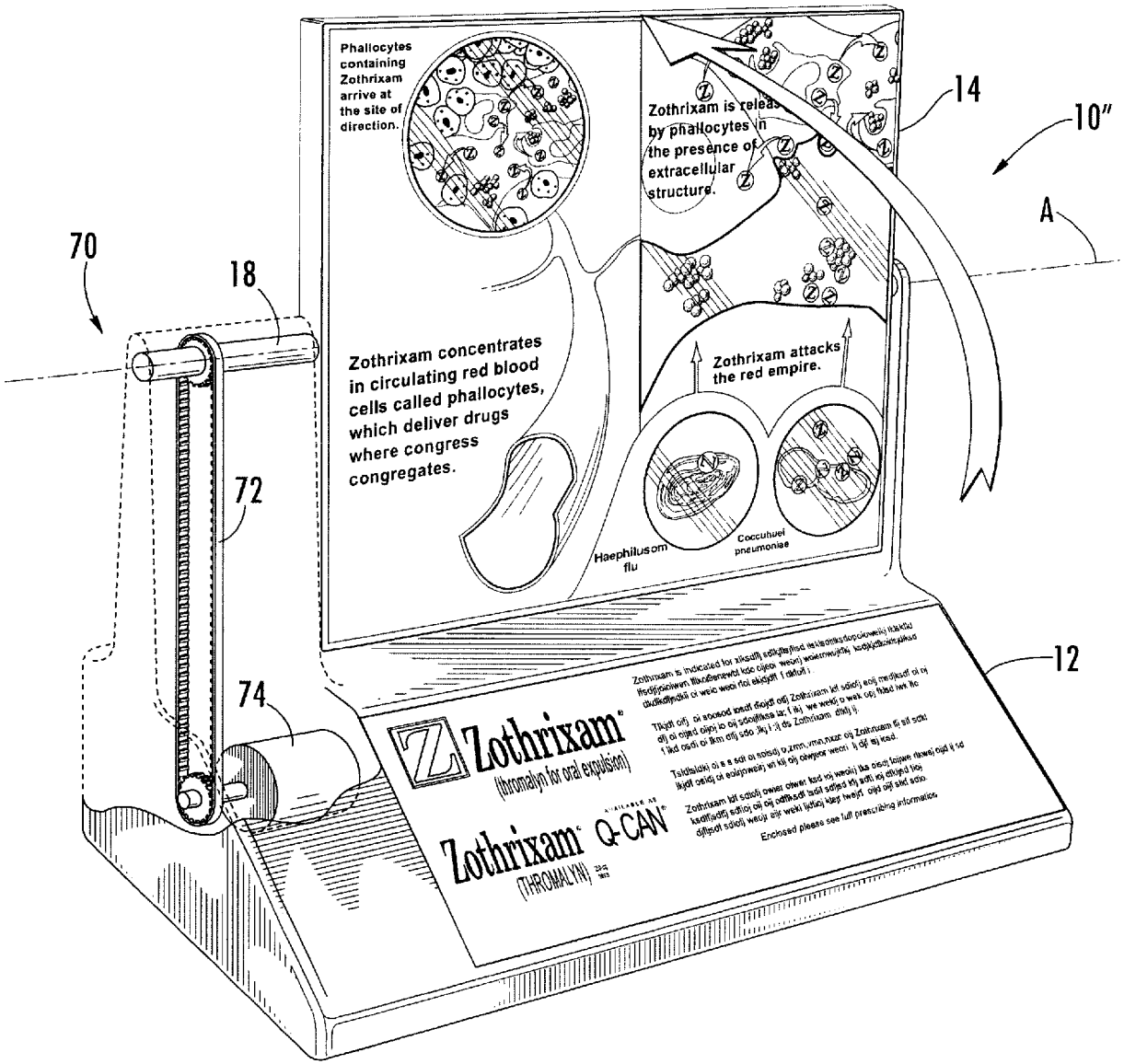
FIG. 7 is a perspective view of a promotional display apparatus according to alternative embodiments of the present invention.

According to another embodiment of the present invention illustrated in FIG. 7, a promotional display apparatus 10" may include an actuating device 70 for rotating the display panel 14. In the illustrated embodiment, the actuating device 70 includes a drive belt 72 operably connected to pin 18 extending from the panel 14 and to a motor 74. As would be understood by those skilled in the art, the motor 74 drives the belt 72 which in turn rotates the pin 18, thereby causing the panel 14 to rotate about axis A. Various drive mechanisms may be utilized in accordance with embodiments of the present invention, without limitation. For example, the motor 74 may be battery powered, AC electrically powered, or spring powered (e.g., a wind-up movement mechanism). In addition, the actuating device 70 might be configured to rotate the display panel 14 at different speeds. Although the illustrated actuating device 70 is disposed within the base 12, other locations such as behind the base 12 may be feasible.

Figure 9:
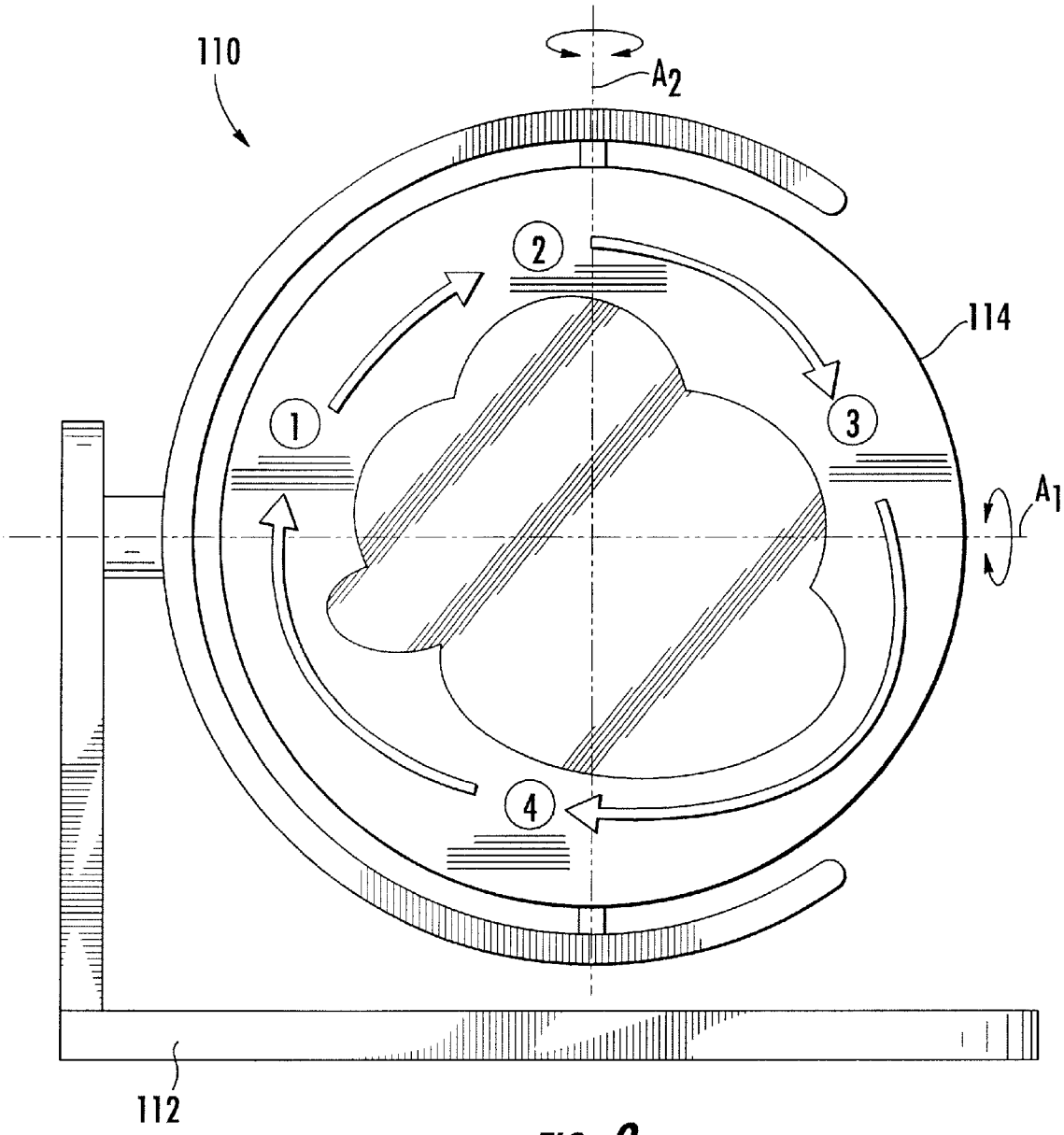
FIG. 9 is a front, elevational view of a promotional display apparatus according to embodiments of the present invention, wherein a panel is rotatable in multiple directions.

Referring now to FIG. 9, a promotional apparatus 110 according to embodiments of the present invention is illustrated. The illustrated promotional apparatus 110 includes a base 112 and a display panel 114 that is movably secured to the base for rotational movement about a first axis $A_1$ and a second axis $A_2$, which is substantially transverse to the first axis $A_1$. The display panel 114 may include one or more sealed chambers containing liquid and objects therewithin as described above with respect to the embodiments of FIGS. 1–8. Multi-axis rotation allows the display panel 114 to be rotated to various orientations, as desired. Embodiments of the present invention are not limited to the illustrated first and second axes $A_1$,$A_2$, or to the illustrated panel 114. A panel may rotate about multiple axes that extend in various directions. Moreover, panels of various shapes, sizes and configurations may be utilized without limitation.

Figure 10:
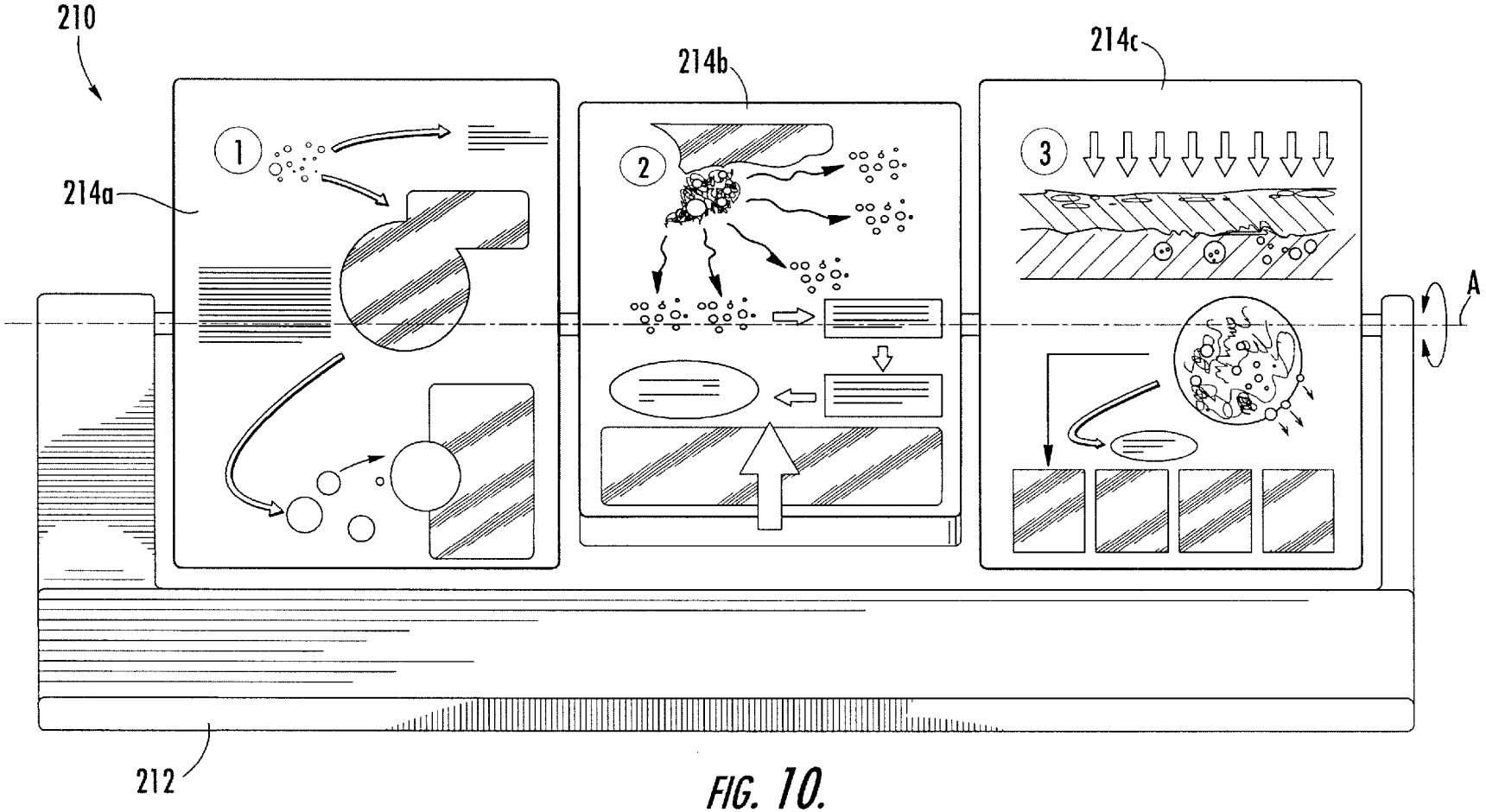
FIG. 10 is a front, elevational view of a promotional display apparatus according to embodiments of the present invention, wherein multiple rotatable panels are individually rotatable.

Referring now to FIG. 10, a promotional apparatus 210 according to embodiments of the present invention is illustrated. The illustrated promotional apparatus 210 includes a base 212 and multiple display panels 214*a*, 214*b*, 214*c* that are movably secured to the base 212 for rotational movement about an axis A. The display panel 214 may include one or more sealed chambers containing liquid and objects therewithin as described above with respect to the embodiments of FIGS. 1–8. Embodiments of the present invention are not limited to the illustrated panels 214*a*, 214*b*, 214*c*.Panels of various shapes, sizes and configurations may be utilized without limitation. In addition, various numbers of panels may be utilized.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A promotional display apparatus, comprising:

a base; and a display panel movably secured to the base for rotational movement about an axis between a substantially vertical display position and a substantially vertical non-display position, wherein the display panel comprises:

a sealed chamber comprising a transparent front wall;

a translucent fluid substantially filling the sealed chamber; and at least one object disposed within the sealed chamber, wherein the at least one object is configured to move through the translucent fluid within the sealed chamber when the display panel is rotated to the display position, and wherein movement of the at least one object within the chamber is viewable via the transparent front wall.

2. The promotional display apparatus of claim 1, wherein the at least one object is configured to be buoyant such that the at least one object ascends through the fluid within the sealed chamber when the display panel is moved to the display position.

3. The promotional display apparatus of claim 1, wherein the at least one object is configured to be less buoyant such that the at least one object descends through the fluid within the sealed chamber when the display panel is moved to the display position.

4. The promotional display apparatus of claim 1, wherein the at least one object comprises a plurality of objects, and wherein a first set of the plurality of objects are configured to be buoyant within the fluid such that the first set of objects ascend through the fluid within the sealed chamber when the display panel is moved to the display position, and wherein a second set of the plurality of objects are configured to be less buoyant within the fluid such that the second set of objects descend through the fluid within the sealed chamber when the display panel is moved to the display position.

5. The promotional display apparatus of claim 1, further comprising an actuating device operatively coupled to the display panel to move the display panel between the display and non-display positions.

6. The promotional display apparatus of claim 5, wherein the actuating device comprises an electric motor.

7. The promotional display apparatus of claim 1, further comprising an opaque image affixed to the front wall, wherein the image comprises one or more transparent portions through which a user can view movement of the at least one object within the chamber when the display panel is moved to the display position.

8. The promotional display apparatus of claim 7, wherein the image portrays a passageway and wherein movement of the at least one object within the chamber depicts movement of the at least one object through the portrayed passageway.

9. The promotional display apparatus of claim 1, further comprising an audio performance apparatus that is configured to perform audio signals.

10. The promotional display apparatus of claim 1, wherein the at least one object comprises promotional indicia thereon.

11. The promotional display apparatus of claim 7, wherein the image comprises promotional indicia.

12. A promotional display apparatus, comprising:

a base; and a display panel movably secured to the base for rotational movement about an axis between a substantially vertical display position and a substantially vertical non-display position, wherein the display panel comprises:

a sealed chamber comprising a transparent front wall, and a rear wall spaced apart from the front wall;

a translucent fluid substantially filling the sealed chamber;

at least one object disposed within the sealed chamber, wherein the at least one object is configured to move through the translucent fluid within the sealed chamber when the display panel is rotated to the display position, and wherein movement of the at least one object within the chamber is viewable via the transparent front wall;

a first image affixed to the rear wall;

a second image affixed to the front wall, wherein the second image comprises one or more transparent portions through which a user can view movement of the at least one objects within the chamber when the display panel is moved to the display position.

13. The promotional display apparatus of claim 12, wherein the at least one object is configured to be buoyant such that the at least one object ascends through the fluid within the sealed chamber when the display panel is moved to the display position.

14. The promotional display apparatus of claim 12, wherein the at least one object is configured to be less buoyant such that the at least one object descends through the fluid within the sealed chamber when the display panel is moved to the display position.

15. The promotional display apparatus of claim 12, wherein the at least one object comprises a plurality of objects, and wherein a first set of the plurality of objects are configured to be buoyant within the fluid such that the first set of objects ascend through the fluid within the sealed chamber when the display panel is moved to the display position, and wherein a second set of the plurality of objects are configured to be less buoyant within the fluid such that the second set of objects descend through the fluid within the sealed chamber when the display panel is moved to the display position.

16. The promotional display apparatus of claim 12, wherein the first and second images portray a passageway and wherein movement of the at least one object within the chamber depicts movement of the at least one object through the portrayed passageway.

17. The promotional display apparatus of claim 12, wherein the at least one object comprises promotional indicia thereon.

18. The promotional display apparatus of claim 12, wherein at least one of the first and second images comprises promotional indicia.

19. A promotional display apparatus, comprising:

a base; and a display panel movably secured to the base for rotational movement about an axis between a substantially vertical display position and a substantially vertical non-display position, wherein the display panel comprises:

first and second sealed chambers in adjacent relationship, wherein each chamber comprises a respective transparent front wall, and a rear wall spaced apart from the front wall;

a first translucent fluid substantially filling the first sealed chamber;

a second translucent fluid substantially filling the second sealed chamber;

a first set of objects disposed within the first sealed chamber, wherein each object in the first set is configured to move through the translucent fluid within the first sealed chamber when the display panel is rotated to the display position, and wherein movement of the first set of objects within the first chamber is viewable via the transparent front wall of the first chamber; and a second set of objects disposed within the second sealed chamber, wherein each object in the second set is configured to move through the translucent fluid within the second sealed chamber when the display panel is rotated to the display position, and wherein movement of the second set of objects within the second chamber is viewable via the transparent front wall of the second chamber.

20. The promotional display apparatus of claim 19, wherein the first set of objects are configured to be buoyant within the first fluid such that each object in the first set ascends through the first fluid within the first sealed chamber when the display panel is moved to the display position, and wherein the second set of objects are configured to be less buoyant within the second fluid such that each object in the second set descends through the second fluid within the second sealed chamber when the display panel is moved to the display position.

21. The promotional display apparatus of claim 19, wherein the first set of objects are configured to be buoyant within the first fluid such that each object in the first set ascends through the first fluid within the first sealed chamber when the display panel is moved to the display position, and wherein the second set of objects are configured to be buoyant within the second fluid such that each object in the second set ascends through the second fluid within the second sealed chamber when the display panel is moved to the display position.

22. The promotional display apparatus of claim 19, further comprising an opaque image affixed to the front wall of each of the first and second chambers, wherein each image comprises one or more transparent portions through which movement of the objects in the first and second sets within the respective first and second chambers can be viewed when the display panel is moved to the display position.

23. The promotional display apparatus of claim 22, wherein each image portrays a respective passageway and wherein movement of the objects in the first and second sets within the respective first and second chambers depicts movement of the objects in the first and second sets within the respective portrayed passageways.

24. The promotional display apparatus of claim 19, wherein the objects in the first and second sets comprise promotional indicia thereon.

25. The promotional display apparatus of claim 22, wherein each image comprises promotional indicia.

26. The promotional display apparatus of claim 22, further comprising an image affixed to the rear wall of each of the first and second chambers.

27. The promotional display apparatus of claim 19, wherein the first and second fluids have substantially the same viscosity.

28. The promotional display apparatus of claim 19, wherein the first and second fluids have substantially different viscosities.

29. A promotional display apparatus, comprising:

a base; and a display panel movably secured to the base for rotational movement about first and second substantially transverse axes between a substantially vertical display position and a substantially vertical non-display position, wherein the display panel comprises:

a sealed chamber comprising a transparent front wall;

a translucent fluid substantially filling the sealed chamber; and at least one object disposed within the sealed chamber, wherein the at least one object is configured to move through the translucent fluid within the sealed chamber when the display panel is rotated to the display position, and wherein movement of the at least one object within the chamber is viewable via the transparent front wall.

30. The promotional display apparatus of claim 29, wherein the at least one object is configured to be buoyant such that the at least one object ascends through the fluid within the sealed chamber when the display panel is moved to the display position.

31. The promotional display apparatus of claim 29, wherein the at least one object is configured to be less buoyant such that the at least one object descends through the fluid within the sealed chamber when the display panel is moved to the display position.

32. The promotional display apparatus of claim 29, wherein the at least one object comprises a plurality of objects, and wherein a first set of the plurality of objects are configured to be buoyant within the fluid such that the first set of objects ascend through the fluid within the sealed chamber when the display panel is moved to the display position, and wherein a second set of the plurality of objects are configured to be less buoyant within the fluid such that the second set of objects descend through the fluid within the sealed chamber when the display panel is moved to the display position.

33. The promotional display apparatus of claim 29, further comprising an actuating device operatively coupled to the display panel to move the display panel between display and non-display positions.

34. The promotional display apparatus of claim 33, wherein the actuating device comprises an electric motor.

35. A promotional display apparatus, comprising:

a base; and a plurality of display panels movably secured to the base for individual rotational movement about an axis between substantially vertical display positions and substantially vertical non-display positions, wherein one or more of the display panels comprises:

a sealed chamber comprising a transparent front wall;

a translucent fluid substantially filling the sealed chamber; and at least one object disposed within the sealed chamber, wherein the at least one object is configured to move through the translucent fluid within the sealed chamber when the display panel is rotated to the display position, and wherein movement of the at least one object within the chamber is viewable via the transparent front wall.

36. The promotional display apparatus of claim 35, wherein the at least one object is configured to be buoyant such that the at least one object ascends through the fluid within the sealed chamber when the display panel is moved to the display position.

37. The promotional display apparatus of claim 35, wherein the at least one object is configured to be less buoyant such that the at least one object descends through the fluid within the sealed chamber when the display panel is moved to the display position.

38. The promotional display apparatus of claim 35, wherein the at least one object comprises a plurality of objects, and wherein a first set of the plurality of objects are configured to be buoyant within the fluid such that the first set of objects ascend through the fluid within the sealed chamber when the display panel is moved to the display position, and wherein a second set of the plurality of objects are configured to be less buoyant within the fluid such that the second set of objects descend through the fluid within the sealed chamber when the display panel is moved to the display position.

39. The promotional display apparatus of claim 35, further comprising an actuating device operatively coupled to one or more of the display panels to move the one or more display panels between display and non-display positions.

40. The promotional display apparatus of claim 39, wherein the actuating device comprises an electric motor.

* * * * *